US005461804A

United States Patent [19]

Perkins, Jr.

[11] Patent Number: 5,461,804

[45] Date of Patent: Oct. 31, 1995

[54] IMAGE SUPPORT APPARATUS

[76] Inventor: Raymond C. Perkins, Jr., 1730 N. Clark St., Apt. 714, Chicago, Ill. 60614

[21] Appl. No.: 91,768

[22] Filed: Jul. 14, 1993

[51] Int. Cl.[6] ..... G09F 1/12

[52] U.S. Cl. ..... 40/152.1; 40/603

[58] Field of Search ..... 40/603, 156, 152.1, 40/617; 248/316.7, 201; 38/102.91

[56] References Cited

U.S. PATENT DOCUMENTS

| | | | |
|---|---|---|---|
| 1,348,245 | 8/1920 | Siewenie | 40/617 |
| 2,614,778 | 10/1952 | Graves . | |
| 2,632,971 | 3/1953 | Monczek et al. | 40/152.1 |
| 3,080,166 | 3/1963 | Clark | 40/603 X |
| 3,419,988 | 1/1969 | Misauskas | 40/152.1 |
| 3,542,365 | 11/1970 | Gantz . | |
| 3,550,299 | 12/1970 | Salz | 40/156 X |
| 3,792,678 | 2/1974 | Rowland | 40/603 X |
| 4,103,446 | 8/1978 | Maglott . | |
| 4,106,852 | 8/1978 | Chosins | 38/102.91 X |
| 5,039,047 | 8/1991 | Pitzo . | |
| 5,050,834 | 9/1991 | Tardiff . | |

*Primary Examiner*—Kenneth J. Dorner
*Assistant Examiner*—Cassandra Davis
*Attorney, Agent, or Firm*—David C. Brezina; Lee, Mann, Smith, McWilliams, Sweeney & Ohlson

[57] ABSTRACT

An image or object support apparatus holds an image or object, such as a photograph, drawing or other graphic work in a spaced position relative to a backing plate. The backing plate is itself supported in the place of display, as by picture hanging means or a stand. The image or object is supported by struts having grippers enabling easy changing of the image or object, and easy adapting to images of various size.

2 Claims, 3 Drawing Sheets

FIG. 12
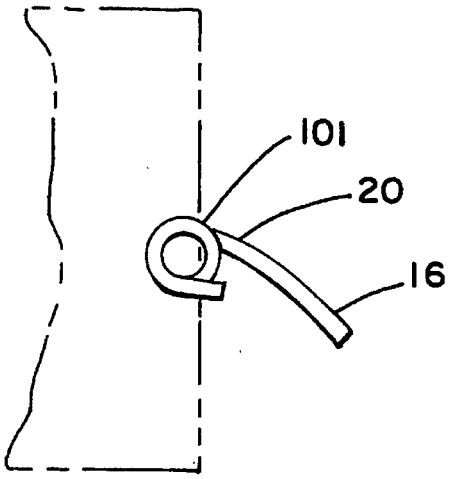
FIG. 11
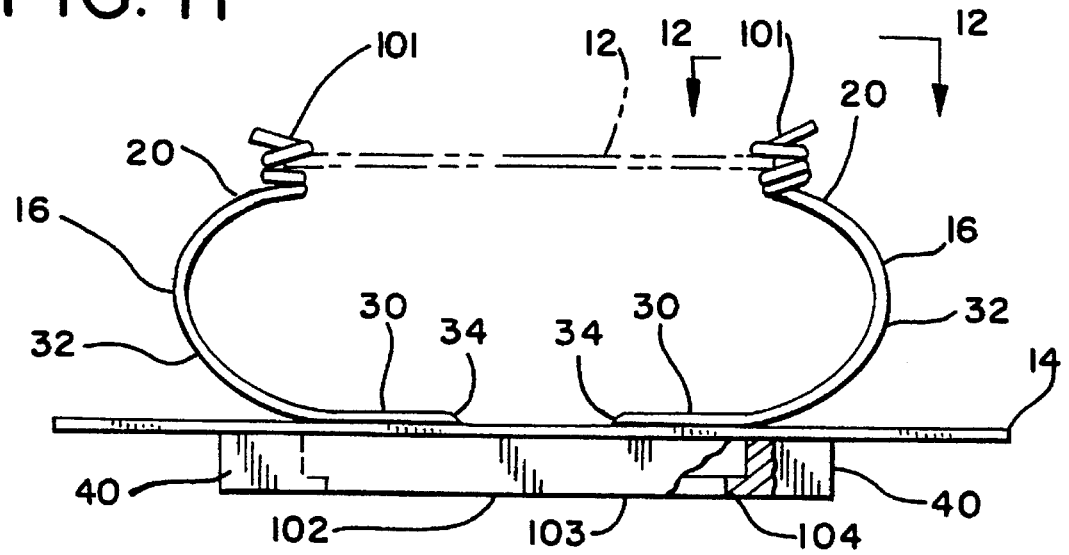
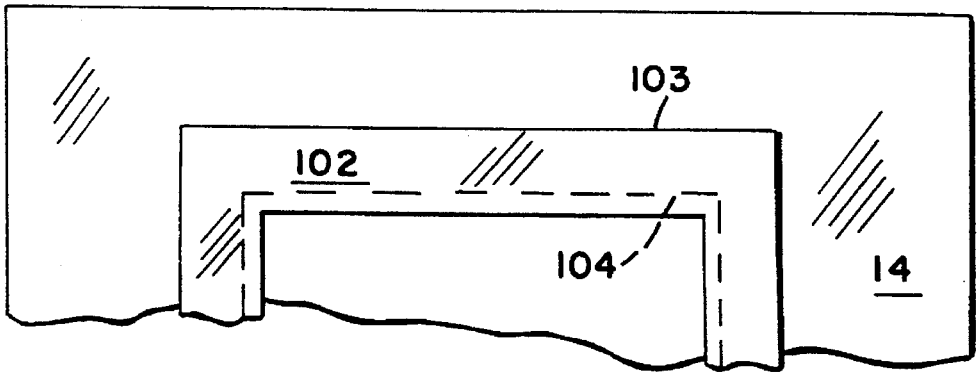
FIG. 13

IMAGE SUPPORT APPARATUS

BACKGROUND OF THE INVENTION

1. Field of the Invention

The invention is an image or object support apparatus which hold an image or object, such as a photograph, drawing or other graphic work in a spaced position relative to a backing plate. The backing plate is itself supported in the place of display, as by picture hanging means or a stand. The image or object is supported by struts having grippers enabling easy changing of the image or object, and easy adapting to images of various size.

2. Description of Related Art

Prior art picture frames, of course, generally hold an image or object inside of some type of framework. Badge holders are known which include sliding frameworks so that matter such as an employee's photograph can be readily inserted.

Picture hangers using corner engaging wire brackets to hold an image or object are known, however, these use an image or object mounted on some form of rigid backing and the wire comer brackets are held on by interlocking them with a flexible "picture wire" that loops through each of the four (4) brackets. This item and dinner plate hangers use wires in tension to apply to compression to an object to hold up the object. The invention does not use compression on the image or object as many images, such as photographs on paper, would bend if in compression. The invention's preferred embodiment with C-shaped wires enable use to apply tension on the image or object if desired, which is a functionally different operation.

Prior art slotted frames enable a paper to be placed in the slots and the slotted frame is supported in position relative to a backing. The preferred embodiment is different using paired slots and spacers to attach them to and hold them away from the backing. Another prior art approach is to use a combination of the slots and magnets. Another prior art apparatus uses combinations of adhesives and magnetic mounting devices of specific male and female configurations with mechanical securement means. A magnetic "L" shaped bracket has been used in the prior art as well. In the invention, an alternative embodiment is different in that it uses two gripper surfaces holding the image or object in between, without identifiable "male" and "female" members.

SUMMARY OF THE INVENTION

This apparatus provides an economic, pleasing and a distinctive appearance in a structure having an economical construction with adaptability to display various size images. The invention comprises a base plate of a planar, rectangular or square form. On the reverse of the plate are spacers and hanging means. This can be hung on a wall, on a traditional picture hanger, nail or the like, or placed using a stand, as on a table or the like.

The base plate has a plurality of struts extending outwardly therefrom. In the preferred embodiment, these struts are flexible, resilient wires extending in a generally C-shaped manner thereby having portions substantially parallel to the planar surface and substantially perpendicular therefrom. At the end of the struts or wires, the preferred embodiment uses one clip per wire. These may be spring loaded clips or other attachment means. An image or object, such as a photograph, is clipped in place on the wires thereby being spaced away from the planar surface giving a "floating" appearance.

Advantages in this configuration include the pleasing appearance, the ability to rapidly and easily change the image or object to suit decorative, subject or other purposes, adaptability to different size images and the ability to use various media for images, whether on paper, transparencies or the like.

The C-shaped arrangement of the struts in the preferred embodiment lets them be bent slightly inwardly or outwardly to accommodate square or rectangular images of varying dimensions or non-rectangular images such as photographs cropped for certain effects.

In addition, the C-shaped struts could be deformed to differing top and bottom radii so as to impart the appearance of a tilt, either upwardly or downwardly, to improve an observer's sight of the image or object, to reduce glare or the like. This can also be done to change the lateral spacing between grippers to adapt to different images.

Alternative embodiments include different strut arrangements and gripping means. Straight rodlike struts could have threaded ends fitting threaded receptacles at selected spaced positions on the base plate. These could then accommodate the varied shaping but not to the infinite degree of the C-shaped wires. The gripping means on the rodlike struts could then be either paired parallel (or downwardly converging) U-shaped channels having closed bottoms thereby defining slots in which a photographic image or object could be placed or, in the second alternative, magnetic elements which could be placed on the outer surface of the image or object in close proximity with magnetized rods, thereby providing greatest protection for the image or object against scratching or the like. The slot arrangement would provide the most rigid structure. One additional potential variation is to use a springy C-shaped wire or strap which would tend to put outwardly directed loads on the corners of a photograph, thereby tending to hold it flat.

BRIEF DESCRIPTION OF THE DRAWINGS

FIG. 11 is a top plan view of another alternative embodiment.

FIG. 12 is a partial front elevation of alternative embodiment.

FIG. 13 is a partial rear elevation of the alternative embodiment.

DETAILED DESCRIPTION OF THE PREFERRED EMBODIMENT

Figure 2:
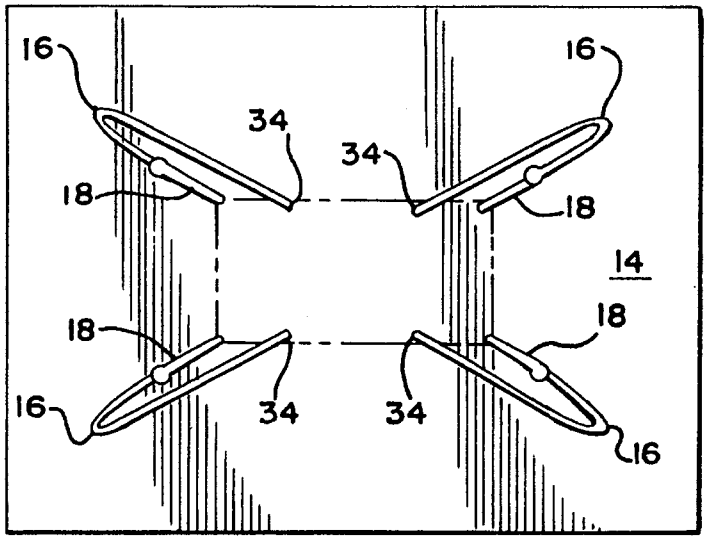
FIG. 2 is front elevational view of the preferred embodiment.
Figure 3:
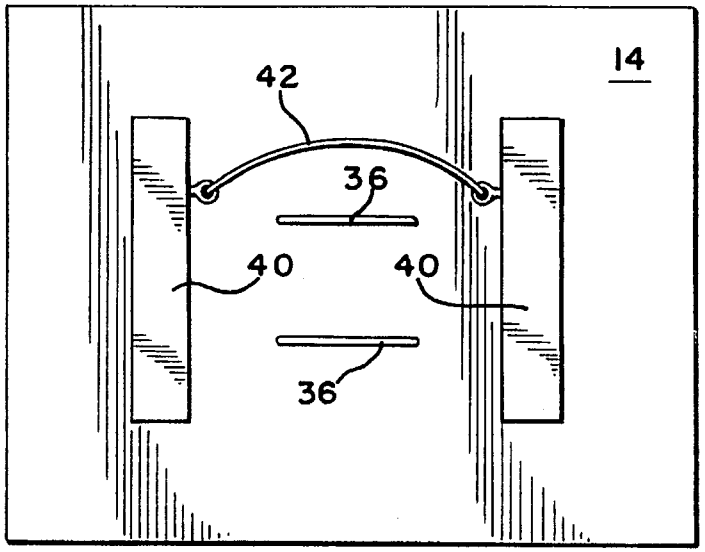
FIG. 3 is a rear elevational view of the preferred embodiment.
Figure 1:
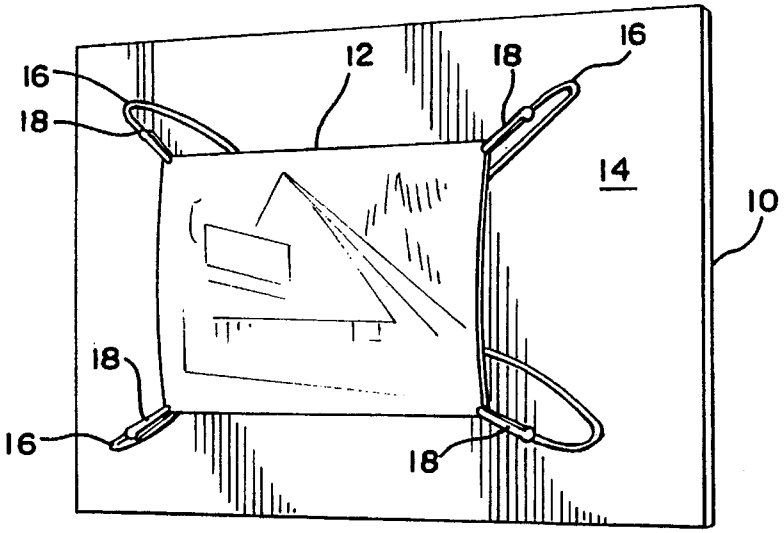
FIG. 1 is a perspective view of the preferred embodiment.
Figure 4:
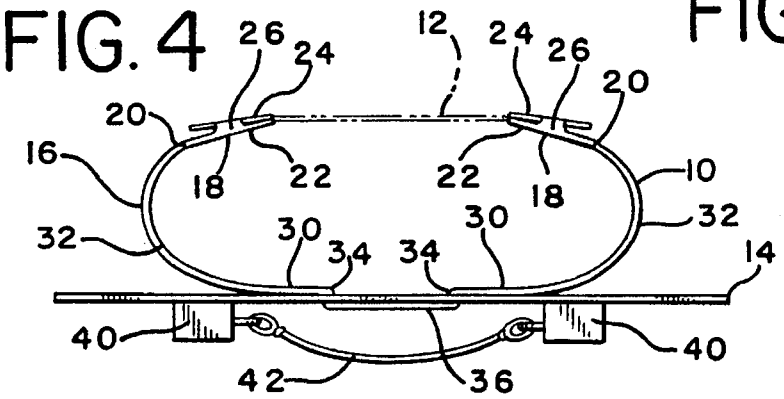
FIG. 4 is a top plan view of the preferred embodiment.

The holder 10 supports an image or object 12 for display purposes. A planar surface 14, in the preferred embodiment a finished metal plate, provides the backing and structure for the holder 10. The surface 14 can be any material finished for pleasing appearance and having the necessary structural support and can be formed in a configuration other than the flat plate shown. Thus, the appearance could be enhanced by the use of a concave or convex surface without departing from the invention.

Struts 16 project outwardly from surface 14. Each strut has a gripper 18 formed at the terminus 20 of strut 16 which is adapted to grip image or object 12. In the preferred embodiment, gripper 18 comprises a first jaw 22 and second jaw 24 connected at pivot 26 so as to capture image or object 12 therebetween.

As can be seen, strut 16 has a base leg 30 merging into a curve leg 32 in the preferred embodiment the curved leg 32 terminating in end 20 where the gripper 18 is formed or attached. In the preferred embodiment, strut 16 is formed with leg 30 and 32 such that it describes a "C" shape thereby enabling gripper 18 to lie with jaws 22, 24 nearly parallel to plate 14. In this manner, certain advantages are presented.

Leg 30 can be arranged to terminate where it is affixed to plate 14 or, in the preferred embodiment, to be mounted to pass through an aperture 34 formed in plate 14. In the preferred embodiment, a length of wire can be formed such that a pair of legs 16 are a continuous length of wire, the respective legs 30 merging into a crossing portion 36 which is concealed from view by virtue of the wire passing through apertures 34 behind plate 14. This provides for ease of assembly while maintaining a pleasing appearance and providing economy in the use of fewer cutting operations and fastening operations to connect or mount strut 16 on plate 14. Nevertheless, other methods of mounting strut 16 to plate 14 could be used without departing from the invention.

Another advantage to the "C" shape of strut 16 is that it can be readily manipulated to form struts of varying depth and width relative to the lateral spacing between grippers 18 so that images of varying geometry can be accommodated and a somewhat wider spacing of grippers 18 can be provided permitting the struts 16 to be resiliently deformably closed in to grip image or object 12 under tension provided by the memory or springiness of the wires in the struts 16. This will assist in holding the image or object 12 in a more or less flat position particularly useful when unmounted photographic paper is used which has a tendency to curl owing to the development process.

Another advantage to the "C" shape is that the terminus of legs 30 and passage through apertures 34 are generally hidden from most angles for viewing the image or object by virtue of the placement of the image or object 12 substantially in front of apertures 34. This then in conjunction with using wires finished along the same manner as plate 14 enhances an aesthetically pleasing "high tech" appearance while accentuating the functional and utilitarian attributes of the invention.

Stringers or braces 40 can be mounted to the reverse of plate 14 and hanging attachments 42, such as picture wire in the preferred embodiment used to support the apparatus in use, such as hanging on a hook from a wall (not shown). The stringers provide additional rigidity against bending of plate 14, provide for placement of the mounting apparatus 42 as well as spacing the plate 14 some distance from the wall thereby enhancing the aesthetic appearance and also enabling clearance for the passage of crossing portion 36 of the wire composing struts 16.

Figure 5:
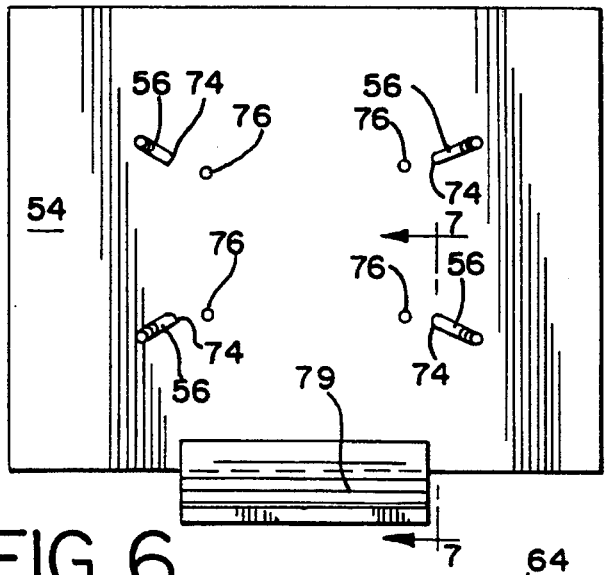
FIG. 5 is a perspective view of an alternative embodiment.
Figure 7:
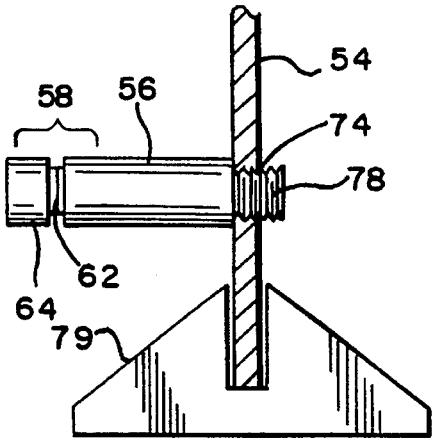
FIG. 7 is a sectional view of an alternative embodiment.
Figure 6:
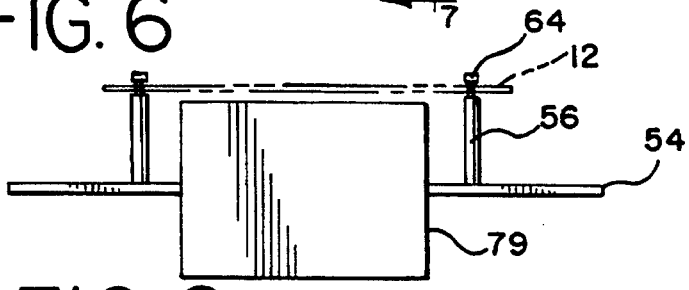
FIG. 6 is a top plan view of an alternative embodiment.

Alternative embodiments may be provided. In a first alternative embodiment, in FIGS. 5–7, struts 56 may be substantially rigid members of cylindrical form mounted perpendicularly to plate 54. In this embodiment, strut 56 supports gripping assembly 58 which comprises a first magnetic element 62 and a second magnetic element 64. The magnetic elements are held together with magnetic force sufficient that image or object 12 can be held in place using a plurality of strut-magnetic element combinations. In the preferred version of this alternative embodiment, four strut-magnetic element combinations can be used. Strut 56 is shown as a non-ferrous material such as an aluminum tube with a ferrous insert 62 attracted to magnetic element 64. Alternatively, the strut may be composed of a ferrous or magnetic material, dispensing with a separate element, while performing the same function, namely attracting element 64, a magnet or complimentary ferrous material.

In this alternative embodiment, it would be preferred to have at least a first array of apertures 74 aligning a plurality of struts 56 with an image or object 12 of a certain perimeter. A second array of apertures 76 could be used to change the lateral spacing and/or perimeter of the strut array to conform to a different size image. It would be preferred to use threaded apertures 74, 76 and a threaded end 78 of the struts for ease of manual movement. This arrangement provides for an aesthetically pleasing retention of the image or object 12 with the supports entirely hidden and the friction caused by the magnetic attraction between elements capturing the image or object providing the means for support. A stand 79 is illustrated which can be utilized to support the base plate 54 on a horizontal surface such as a table top. This stand 79 could be used on the other embodiments as well. While magnetic attractive elements 62, 64 are preferred, it may be advantageous to use alternatives such as elements composed of a material having electrostatic attraction or adhesive attraction.

Figure 8:
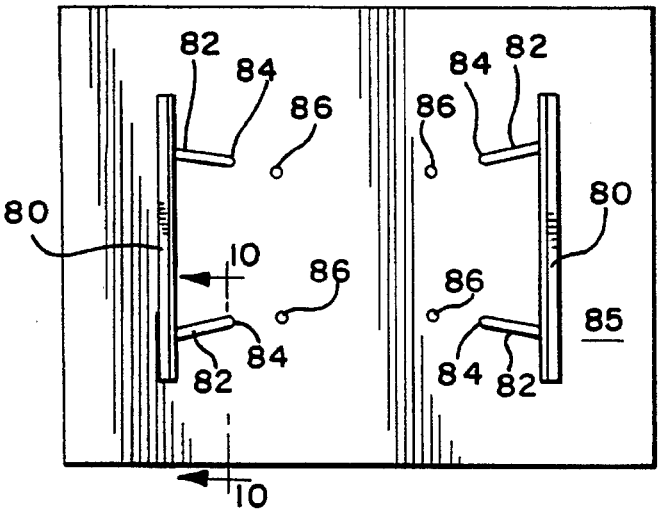
FIG. 8 is a perspective view of another alternative embodiment.
Figure 10:
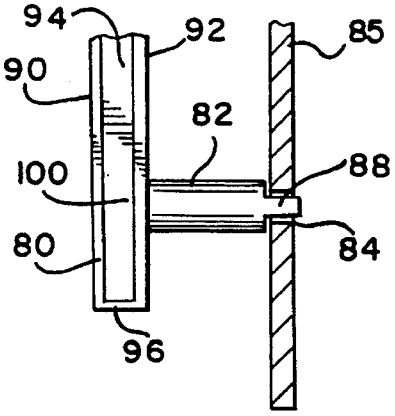
FIG. 10 is a sectional view of the other alternative embodiment.
Figure 9:
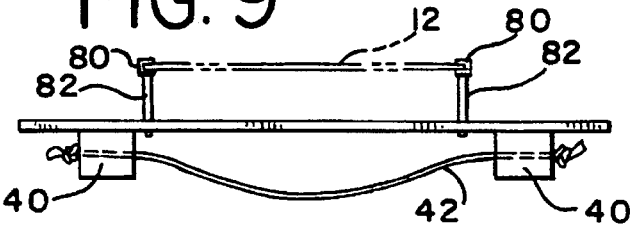
FIG. 9 is a top plan view of the alternative embodiment.

Another alternative is shown in FIGS. 8–10. In this embodiment a pair of opposed brackets 80 are mounted on rigid struts 82. The struts 82 are fitted in apertures 84 in base plate 85, with another array of apertures 86 adapted to receive the struts 82 in different lateral spacing. Because of the mounting to brackets 80, it would be preferred in this alternative to use a pin end 88 as threads such as in FIG. 7 could not easily be used. Pin end 88 can be adapted to a compression fit in aperture 84.

Brackets 80 have a front flange, 90 a rear flange, 92, a side web 94 joining the flanges 90, 92, and a bottom stop, 96. The flanges 90, 92, web 94 and stop 96 define a slot 100 between them. The image or object 12 can be fitted in the slot 100 and rest on stop 96.

Another alternative is shown in FIG. 11. In this embodiment the strut 16 has end 20 formed as a helical coil 101 to hold the image or object 12. By opening the helical coil, through pressure by the edge of the image, or by a fingernail, the image can be place between coils, utilizing the tensile strength of the coil to hold the image in place.

A preferably plastic foam hanger 102 (which may be die cut, or molded) is formed with walls 103 arranged in the shape of square or a rectangle, with the interior of the square or rectangle proportionately removed, leaving a void in the interior of the square or rectangle. Rim 104 can be formed to grip a hanger, hook or nail in a wall. This shape is then attached to the back of the frame and can be utilized to hang or mount the support apparatus.

This foam hanger 102 can also serve to attach C-shaped wires to rear of plate 14 by means of compressing them between foam hanger 102 and plate 14 with any suitable adhesive.

In accordance with my invention, I claim:

1. An apparatus for display of a substantially planar object, the apparatus comprising:

a base having a front surface and a back surface, and a peripheral edge extending therearound;

means for supporting the object in spaced relationship with said front surface of said base, said means for supporting being connected, at one end, to said base at a point and protecting outwardly from said base, said means for supporting includes a flexible wire looped through an aperture formed in said base and said flexible wire attached on said back surface of said base; and means for holding the object, said holding means being attached to the other end of said means for supporting.

2. An apparatus for display of a substantially planar object, the apparatus comprising:

a base having a front surface and a back surface, and a peripheral edge extending therearound;

means for supporting the object in spaced substantially parallel relationship with said front surface of said base, said means for supporting being connected to said base at a point and projecting outwardly from said base; and means for holding the object, said holding means being attached to said means for supporting wherein said base comprises a rigid, planar surface with four apertures formed in said base, each aperture defining one corner of a rectangle; said means for supporting comprising two flexible wires, each wire being looped through a selected two of said apertures of said rectangle; said flexible wires are fixed to said base; said means for holding being operatively connected to said wires and being comprised of clips.

* * * * *